US009270027B2

(12) United States Patent
Waschenko et al.

(10) Patent No.: US 9,270,027 B2
(45) Date of Patent: Feb. 23, 2016

(54) NOTCH-ANTENNA ARRAY AND METHOD FOR MAKING SAME

(71) Applicants: Donald P. Waschenko, Ambler, PA (US); Christine D. Genco, Souderton, PA (US)

(72) Inventors: Donald P. Waschenko, Ambler, PA (US); Christine D. Genco, Souderton, PA (US)

(73) Assignee: Sensor and Antenna Systems, Lansdale, Inc., Lansdale, PA (US)

( * ) Notice: Subject to any disclaimer, the term of this patent is extended or adjusted under 35 U.S.C. 154(b) by 269 days.

(21) Appl. No.: 13/758,789

(22) Filed: Feb. 4, 2013

(65) Prior Publication Data

US 2014/0218251 A1 Aug. 7, 2014

(51) Int. Cl.

| | |
|---|---|
| ***H01Q 13/10*** | (2006.01) |
| ***H01Q 13/08*** | (2006.01) |
| ***H01Q 21/00*** | (2006.01) |
| ***H01Q 21/06*** | (2006.01) |
| ***H01P 11/00*** | (2006.01) |

(52) U.S. Cl.

CPC ..... *H01Q 13/10* (2013.01); *H01P 11/00* (2013.01); *H01Q 13/085* (2013.01); *H01Q 21/0087* (2013.01); *H01Q 21/064* (2013.01); *Y10T 29/49016* (2015.01)

(58) Field of Classification Search

CPC .... H01Q 13/085; H01Q 13/10; H01Q 21/064
See application file for complete search history.

(56) References Cited

U.S. PATENT DOCUMENTS

| | | | | |
|---|---|---|---|---|
| 3,836,976 | A | | 9/1974 | Monser et al. |
| H190 | H | | 1/1987 | Gutleber |
| 4,978,965 | A | | 12/1990 | Mohuchy |
| 5,175,560 | A | * | 12/1992 | Lucas et al. ..... 343/767 |
| 5,185,611 | A | | 2/1993 | Bitter, Jr. |
| 5,220,330 | A | | 6/1993 | Salvail et al. |
| 5,461,392 | A | | 10/1995 | Mott et al. |
| 5,659,326 | A | | 8/1997 | McWhirter et al. |
| 5,745,076 | A | | 4/1998 | Turlington et al. |
| 5,786,792 | A | | 7/1998 | Bellus et al. |
| 5,845,391 | A | | 12/1998 | Bellus et al. |
| 5,940,031 | A | | 8/1999 | Turlington et al. |
| 5,949,382 | A | | 9/1999 | Quan |
| 6,005,531 | A | | 12/1999 | Cassen et al. |
| 6,127,984 | A | | 10/2000 | Klebe et al. |

(Continued)

OTHER PUBLICATIONS

International Search Report and Written Opinion for Application No. PCT/US2014/014481, 9 pgs.

(Continued)

*Primary Examiner* — Robert Karacsony
(74) *Attorney, Agent, or Firm* — Morgan, Lewis & Bockius LLP

(57) ABSTRACT

The notch-antenna array includes at least one notch-antenna array element that includes a first notch-antenna radiator, and a second notch-antenna radiator disposed at an angle to said first notch-antenna radiator. The angle is preferably 90 degrees and the element is either a slant antenna or an orthogonal antenna. The first notch-antenna radiator and the second notch-antenna radiator are formed integrally with one another. Each of the first and second notch-antenna radiators has substantially planar opposing surfaces and a flared notch formed therein. Each of the first and second notch-antenna radiators have substantially planar opposing surfaces and a slot configured to receive a printed circuit board therein formed between the substantially planar opposing surfaces. The printed circuit board includes a substrate with one or more dielectric layers, and a feedline.

19 Claims, 12 Drawing Sheets

(56) References Cited

U.S. PATENT DOCUMENTS

| | | | | |
|---|---|---|---|---|
| 6,166,701 | A | 12/2000 | Park et al. | |
| 6,181,291 | B1 | 1/2001 | Anderson et al. | |
| 6,501,426 | B2 | 12/2002 | Waterman | |
| 6,552,691 | B2 | 4/2003 | Mohuchy et al. | |
| 6,600,453 | B1 | 7/2003 | Hadden, IV et al. | |
| 6,771,226 | B1 | 8/2004 | Dujmovic | |
| 6,778,145 | B2 | 8/2004 | Toland et al. | |
| 6,842,154 | B1 | 1/2005 | Apostolos | |
| 6,850,203 | B1 | 2/2005 | Schuneman et al. | |
| 6,867,742 | B1 | 3/2005 | Irion, II et al. | |
| 6,963,312 | B2 | 11/2005 | Schuneman et al. | |
| 7,106,268 | B1 | 9/2006 | Angelucci | |
| 7,138,952 | B2 | 11/2006 | Mcgrath et al. | |
| 7,170,446 | B1 | 1/2007 | West et al. | |
| 7,180,457 | B2 | 2/2007 | Trott et al. | |
| 7,315,288 | B2 | 1/2008 | Livingston et al. | |
| 7,403,169 | B2 * | 7/2008 | Svensson et al. | 343/767 |
| 7,511,664 | B1 | 3/2009 | Mason et al. | |
| 7,615,863 | B2 | 11/2009 | Yang et al. | |
| 7,728,771 | B2 | 6/2010 | Lee et al. | |
| 8,031,126 | B2 | 10/2011 | Cunningham | |
| 2002/0180655 | A1 | 12/2002 | Mohuchy et al. | |
| 2004/0004580 | A1 * | 1/2004 | Toland et al. | 343/893 |
| 2005/0088353 | A1 | 4/2005 | Irion, II et al. | |
| 2011/0148725 | A1 | 6/2011 | Cavener et al. | |

OTHER PUBLICATIONS

Sensor and Antenna Systems, Lansdale, Inc., International Preliminary Report on Patentability, PCT/US2014/014481, Aug. 4, 2015, 6 pgs.

* cited by examiner 206
204
202
400
402
404

NOTCH-ANTENNA ARRAY AND METHOD FOR MAKING SAME

FIELD OF THE INVENTION

The present invention relates generally to antenna arrays and more specifically relates to a notch-antenna array and a method of making same.

BACKGROUND OF THE INVENTION

In communication systems, radar, direction finding and other broadband multifunction systems having limited aperture space, it is often desirable to couple a radio frequency receiver and/or transmitter to an array of antenna elements. It is also desirable that such an array have dual polarized antenna elements, which are capable of achieving significant performance advantages over single polarization antenna arrays. The dual polarization antenna is particularly useful with energy waves such as those employed in the radio frequency spectrum having two orthogonal components which are orthogonally polarized with respect to each other. The orthogonal polarization of the energy waves allows for the possibility of broadcasting two different signals at the same operating frequency, thereby doubling the information sent at the same frequency by using two separate antennas. In doing so, one signal is derived from the principle polarized antenna element and the second signal is derived from the orthogonal polarized antenna element.

One such type of dual polarized antenna array is known as a notch-antenna. A notch-antenna array is an antenna array that radiates and/or collects RF energy through an array of notches or slots. Notch-antennas typically exhibit wide beam with broad bandwidth characteristics, advanced beam-forming compatibility, and a low radar cross-section compatibility.

To manufacture such an array, separate semi-rigid coaxial cables are fed through a channel in each antenna and bonded into place with an electrically conductive adhesive. Accurate and uniform placement of these cables to ensure proper electrical contact is tedious and is often performed with minimal or obscured visibility. Moreover, the viscosities of the conductive adhesives/epoxies used to bond the cables in place varies as the adhesives begin to cure. Inconsistencies of the adhesive viscosity leads to varying amounts of adhesive being applied throughout the manufacturing process, which leads to non-uniform antenna element-to-element electrical radiation performance usually resulting in inconsistent voltage standing wave ratios (VSWR). As VSWR increases, efficiency of the antenna radiator decreases. Non-uniformity of the elements also leads to other performance issues including higher radiation pattern sidelobes, higher mutual coupling, and higher backscatter adding to radiation performance differences throughout the field of view of the desired radiation pattern.

These manufacturing and performance issues are typically experienced for radiator antenna elements operating at higher frequencies such as above 300 MHz where the antenna element size is physically smaller. At millimeter wave frequencies above 20 GHz, where wavelengths are less than six tenths of an inch, these manufacturing and performance issues are pronounced.

In general, multiple antenna radiators are assembled in an egg crate or honeycomb type of array structure. This type of array structure has substantial drawbacks. To ensure intimate electrical connection between adjacent radiating elements, conventional manufacturing techniques require electrically conductive fillets at the joints between adjacent radiator elements. However, applying these fillets after the antenna radiators are assembled into the planar array orientation is difficult as physical obstruction prevents proper application of the adhesive. For higher frequency arrays, such as at millimeter-wave frequencies, the physical obstruction is exacerbated.

While such fabrication may be feasible when making a small number of large-sized (low frequency) antenna arrays, it quickly becomes unfeasible when making large arrays of dozens of small high frequency antenna radiators.

In light of the above drawbacks, existing notch-antennas are difficult, time-consuming, and expensive to manufacture. Therefore, it would be highly desirable to have a notch-antenna array that addresses the above described drawbacks by minimizing the number of components in the assembly, simplifying the assembly process, and reducing the cost of manufacture.

SUMMARY

In order to address the above described problems and limitations, rather than potting or encapsulating semi-rigid coaxial cables into each antenna radiator, the present invention provides integrally formed antenna radiator elements each having slots therein into which is inserted a low cost printed circuit board (such as multi-layer stripline, coplanar waveguide, or microstrip printed wired board (PWB)).

Some embodiments of the invention provide a notch-antenna array that includes at least one notch-antenna array element. Where at least one notch-antenna array element includes a first notch-antenna radiator, and a second notch-antenna radiator disposed at an angle to said first notch-antenna radiator. Some embodiments include a notch-antenna array having an integral pair of notch-antenna radiators disposed at an orthogonal angle to one another. In some embodiments, the angle is 90 degrees and the element is a slant antenna, while in other embodiments the element is an orthogonal antenna. The first notch-antenna radiator and the second notch-antenna radiator are formed integrally with one another. In some embodiments, each of the first and second notch-antenna radiators has substantially planar opposing surfaces and a flared notch formed therein. In some embodiments, the first and second notch-antenna radiators are an aluminum block with a flared notch formed therein.

In some embodiments, each of the first and second notch-antenna radiators has substantially planar opposing surfaces and a slot formed between the substantially planar opposing surfaces. The slot is configured to receive a printed circuit board therein. The printed circuit board includes a substrate with one or more dielectric layers, and a feedline. The feedline is disposed on or within the printed circuit board. Alternatively, the printed circuit board comprises opposing substantially planar dielectric layers with a conductive layer forming a feedline there between. In some embodiments, the printed circuit board includes a first conductive layer forming a feedline, a first dielectric layer on a first side of the first conductive layer, a second dielectric layer on a second side of the first conductive layer, a second conductive layer on the first dielectric layer, and a third conductive layer on the second dielectric layer.

In some embodiments, the element is formed by electric discharge machining, while in other embodiments, the element is cast metal or metalized injection molded plastic.

In some embodiments, the notch-antenna array further includes multiple identical elements arranged in a row, wherein all elements in the row are formed integrally with one another. Also in some embodiments, the notch-antenna array includes multiple identical rows of elements stacked adjacent to one another. Electronics may be electrically coupled to each element in the row, where the electronics have a footprint no larger than the row of elements. In some embodiments, each first antenna radiator of each element in each row includes a respective first slot, and all respective first slots are coplanar and configured to receive a single first printed circuit board therein. Each second antenna radiator of each element in the row includes a respective second slot, and each respective second slot is configured to receive its own second printed circuit board therein.

Some embodiments of the invention provide a method for making a notch-antenna. A notch-antenna array element or row of elements is integrally formed using any suitable technique, such as by using electric discharge machining, casting, injection molding or the like. In other embodiments, antenna radiators may be machined using conventional CNC, or advanced machining such as laser, water-jet, plasma, ultrasonic EDM. The row may then require post-machining to attain its final dimensions. Circuit boards are manufactured and then inserted into each antenna radiator. Electronics are then electrically coupled to each slice, and multiple slices stacked adjacent to one another.

The above described embodiments provide a low cost notch-antenna array.

BRIEF DESCRIPTION OF THE DRAWINGS

For a better understanding of the aforementioned aspects of the invention as well as additional aspects and embodiments thereof, reference should be made to the Description of the Embodiments below, in conjunction with the following drawings. These drawings illustrate various portions of the Notch-antenna array. It should be understood that various embodiments besides those directly illustrated can be made to encompass the concepts of this invention.

Like reference numerals refer to corresponding parts throughout the drawings.

DESCRIPTION OF EMBODIMENTS

Reference will now be made in detail to embodiments, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, and components have not been described in detail so as not to unnecessarily obscure aspects of the embodiments.

The terminology used in the description of the invention herein is for the purpose of describing particular embodiments only and is not intended to be limiting of the invention. For example, the terms antenna or radiator are used interchangeably herein. Furthermore, the term notch-antenna as used herein includes, without limitation, notch-antennas, slot notch, slot antennas, linear notches, stepped notches and exponential tapered notch radiator as well as Vivaldi notch-antenna radiators. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items.

Figure 1C:
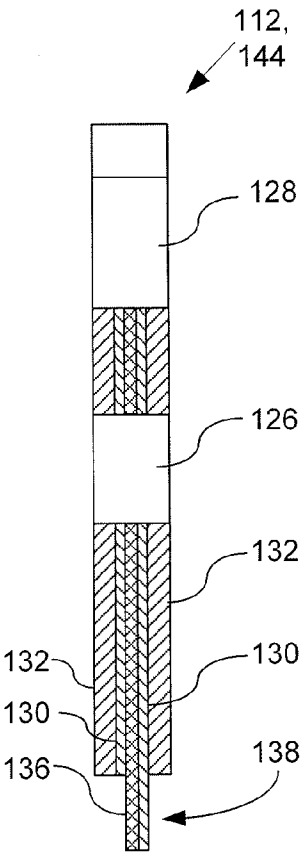
FIG. 1C is a cross sectional view of one of the printed circuit boards shown in FIG. 1B as taken along line XX'.
Figure 1B:
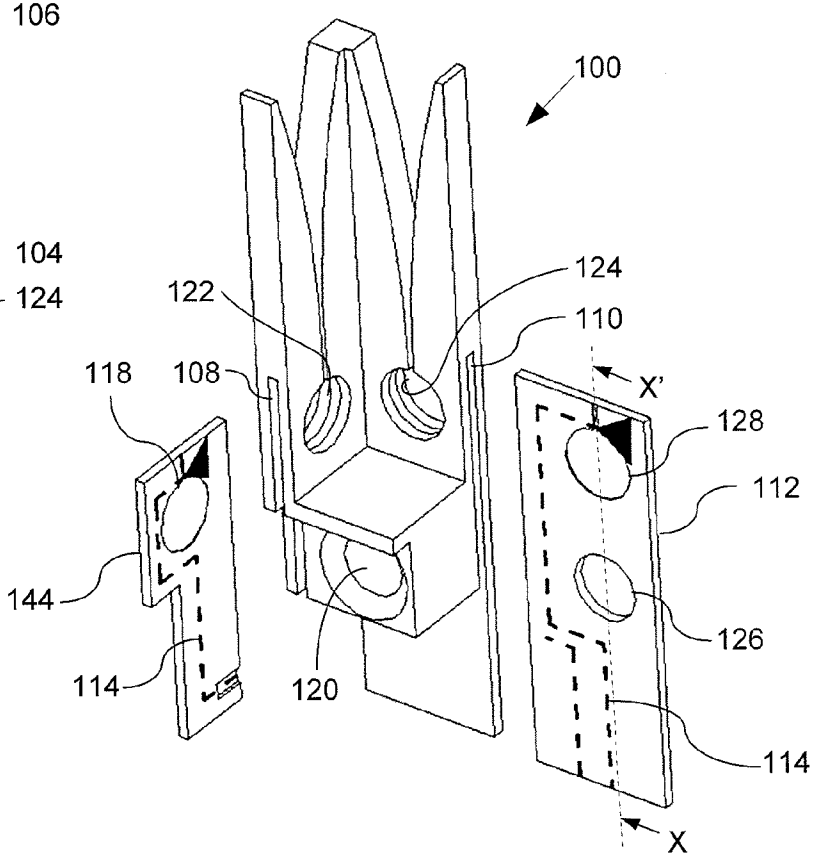
FIG. 1B an exploded isometric view of the notch-antenna array element of FIG. 1A and printed circuit boards for the notch-antenna array element.
Figure 1A:
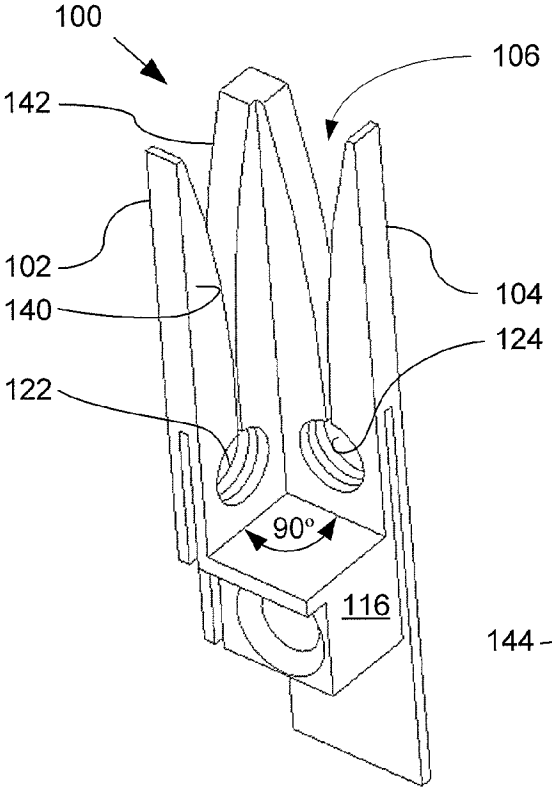
FIG. 1A is an isometric view of a notch-antenna element array according to an embodiment of the invention.

FIG. 1A is an isometric view of a notch-antenna array element 100 according to an embodiment of the invention. In some embodiments, this notch-antenna array is a dual linear polarized phased array. The notch-antenna array element 100 includes a first notch-antenna radiator 102 and a second notch-antenna radiator 104 disposed at an angle to said first notch-antenna radiator 102. In some embodiments, such as that shown in FIG. 1A, the angle is 90 degrees and is an orthogonal antenna. In some embodiments, each pair of integrally formed antennas radiators form a dual orthogonal polarized notch array element.

In some embodiments, two antennas 102, 104 and a base 116 are formed as a single integrated element 100, as shown. In other embodiments, a row of more than two antenna radiators and a base 116 are formed integrally with one another.

In some embodiments, each of the first and second notch-antenna radiators 102, 104 have substantially planar opposing surfaces (e.g., 140,142) and a flared notch (e.g., 106) formed therein. In some embodiments, each of the first and second notch array antenna radiators are Vivaldi antennas, where each notch flares from a central hole 122 or 124 respectively.

The feed hole may be any shape, such as circular, elliptical, rectangular or any other suitable shape to ensure proper matching of feed line to the notch radiator 102 or 106 respectively. Any other suitable antenna radiator design may be used, e.g., a straight non-flared slot etc.

Unlike conventional notch-antenna radiators, the first notch-antenna radiator 102 and the second notch-antenna radiator 104 are formed integrally with one another, i.e., the element 100 is formed out of the same material at the same time and the antenna radiators are not separately manufactured and connected together. The first and second antenna radiators 102, 104 are also integrally connected to a base 116. In some embodiments, the base 116 includes a hole 120 therein used when manufacturing the element 100 or when assembling arrays of multiple notch radiator elements 100.

In some embodiments, the element 100 is formed from a solid block of material, such as aluminum, thereby providing inherent direct physical electrical contact between the radiators and with the base plate metal structure (described below). In some embodiments, the element 100 is formed by electrical discharge machining with or without additional milling, as described below in relation to FIG. 10.

FIG. 1B an exploded isometric view of the notch-antenna array element 100 of FIG. 1A with printed circuit boards 112, 144. In some embodiments, for each antenna radiator 102, 104, a slot 108, 110 is formed between the substantially planar opposing surfaces (e.g., 140,142 of FIG. 1A). Each slot 108, 110 is configured to receive a printed circuit board (PCB) (otherwise known as a printed wiring board or feed card) 112, 144 therein. This allows for low cost printed circuit technology to be used such as microstrip or stripline technologies. Each PCB 112, 144 includes a respective antenna feedline 114 disposed on or within the PCB. A similar process to forming traces on a PCB is used for forming the feedlines 114. Each PCB 112, 144 is configured to be slid into a respective slot 108, 110 of the first and second antenna radiators 102, 104.

In some embodiments, each PCB contains the feed transmission lines and all required matching circuit elements, components, stubs, etc. In some embodiments, each PCB is electrically connected to other electronics through a connector, wire bonding, or the like. In an alternative embodiment, the printed circuit feed boards may also be fully integrated with the front end electronics such as limiters, low noise amplifiers (LNAs), etc., allowing a common module board for each row of elements (as described below), thereby eliminating or reducing the number of required connections.

In some embodiments, each PCB 112, 144 includes one or more holes 118, 126, 128 therein to match the holes 122, 120, 124 formed in the element 100. In some embodiments, these holes are required for signal transmission or reception. In other embodiments, the holes are used for manufacturing and/or assembling the antenna array. The holes 122, 120, 124 also serve an additional function of allowing an assembler to quickly determine whether ach PCB 112, 144 has been fully inserted into its respective slot 108, 110.

One advantage of making the PCBs 112, 144 separate from the element 100 is eliminating the need to snake a feedline wire through a channel formed in an antenna radiator, as was common in the prior art. These PCBs or feed circuit cards are inserted without the need for electrically conductive epoxies aiding assembly and maintenance Simply sliding a PCB into a slot in the antenna greatly improves assembly efficiency and drastically reduces manufacturing costs and time.

The PCBs can be interconnected to adjacent electronic modules or the PCBs may include coplanar waveguide (CWG) transitions to simplify connection to adjacent electronic modules with low cost wire bonds eliminating the high cost of connectors in the assembly of radiators to electronic front ends.

In some embodiments, the slots 108, 110 and PCBs 112, 144 are manufactured to tight tolerances. As each PCB slides into a respective slot, alignment of the feedline within the antenna is accurate. In some embodiments, each slot and corresponding PCB may include a key (e.g., a slot and mating protrusion) to further ensure alignment.

FIG. 1C is a cross sectional view of one of the printed circuit boards 112 and/or 144 shown in FIG. 1B as taken along line XX' of FIG. 1B. The PCBs are typically two layer laminates such as Rogers Duroid 5880 containing the copper feed lines centered within the two substrates. The exterior sides of the substrate are copper or plated copper to prohibit corrosion and allow for preferred ground plane for the embedded stripline feeds. The PCBs are inserted into the slots without necessarily requiring conductive epoxies. The PCBs may contain Coplanar waveguide transitions to aid in interconnecting RF front end circuit cards assemblies (CCA). Alternatively, the PCBs may be an integral part of the RF CCA (described below); thereby eliminating the need for interconnects. In some embodiments, the orthogonal elements 102 have their feed lines 114 on PCB 144 transitioned to a common substrate 112 such that the feedlines 114 on the orthogonal PCBs 144 cross over to the common substrate 112 for all arrayed 104 elements in a common plane PCB.

In some embodiments, the PCB includes a single dielectric layer 130, while in other embodiments, the PCB includes two dielectric layers 130. A conductive layer 136, which includes the feedline, is disposed on one of the dielectric layers 130. In some embodiments, the conductive layer 136 is sandwiched between the two dielectric layers 130, as shown in FIG. 1C.

In some embodiments, the dielectric layers 130 (with the conductive layer 136 there between) is sandwiched between two additional conductive layers 132, as shown. Also in some embodiments, the conductive layer 136 with at least one of the dielectric layers 130 extends from one end of the PCB 112, 144, as shown by reference numeral 138, so that the PCB can connect to the remainder of the antenna electronics.

Figure 2A:
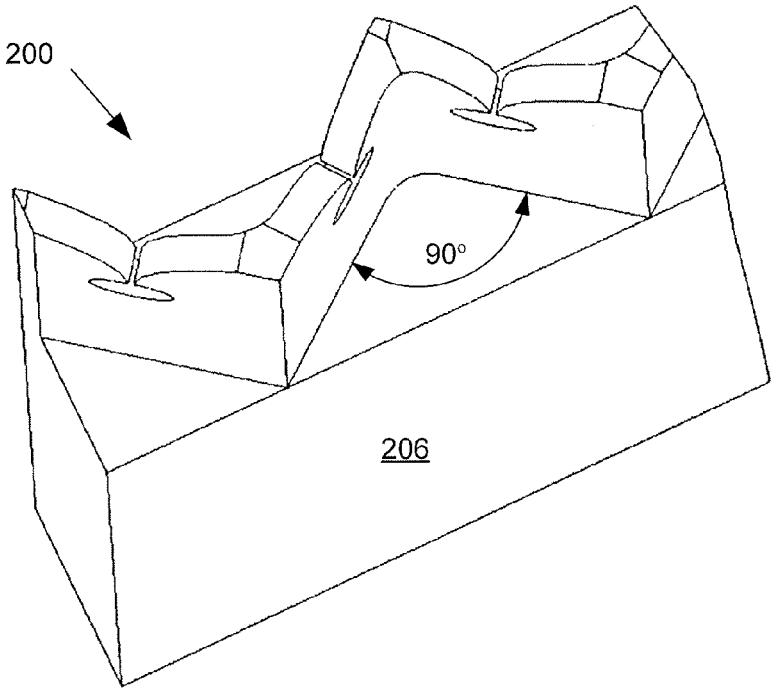
FIG. 2A is an isometric view of notch-antenna array elements according to another embodiment of the invention.
Figure 2B:
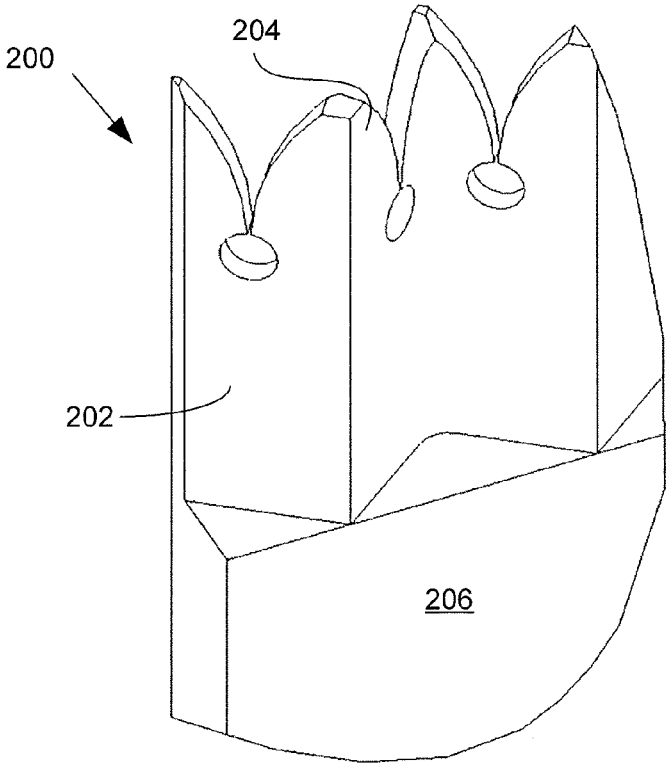
FIG. 2B is different isometric view of the notch-antenna array elements of FIG. 2A.

FIG. 2A is an isometric view of notch-antenna array elements 200 according to another embodiment of the invention, while FIG. 2B is different isometric view of the notch-antenna array elements of FIG. 2A. Each notch-antenna array element 200 includes a first notch-antenna radiator 202 and a second notch-antenna radiator 204 disposed at an angle to said first notch-antenna radiator 202. In some embodiments, such as that shown in FIGS. 2A and 2B, the angle is 90 degrees and the element is a slant antenna. In some embodiments, each pair of integrally formed antenna radiators form a slant polarized notch array element. In this slant antenna configuration, a row of antenna radiators form a zigzag pattern as shown.

Each element of at least two antenna radiators is integrally formed. In some embodiments, the two antenna radiators 202, 204 and a base 206 are formed integrally with one another to form a single antenna array element 200. In other embodiments, like the one shown in FIG. 2B, a row of more than two antenna radiators and a base 206 are integrally formed.

In some embodiments, other than the orientation of the antenna radiators, the array element 200 is identical to the array element 100 (FIG. 1A).

Figure 3A:
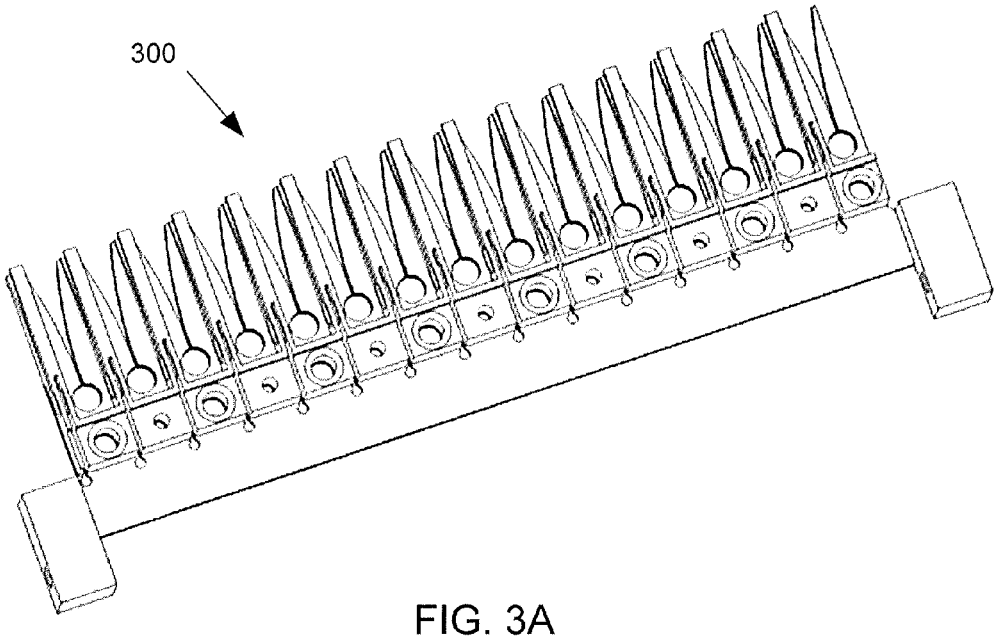
FIG. 3A is an isometric view of a row of the notch-antenna array elements shown in FIGS. 1A and 1B.
Figure 3B:
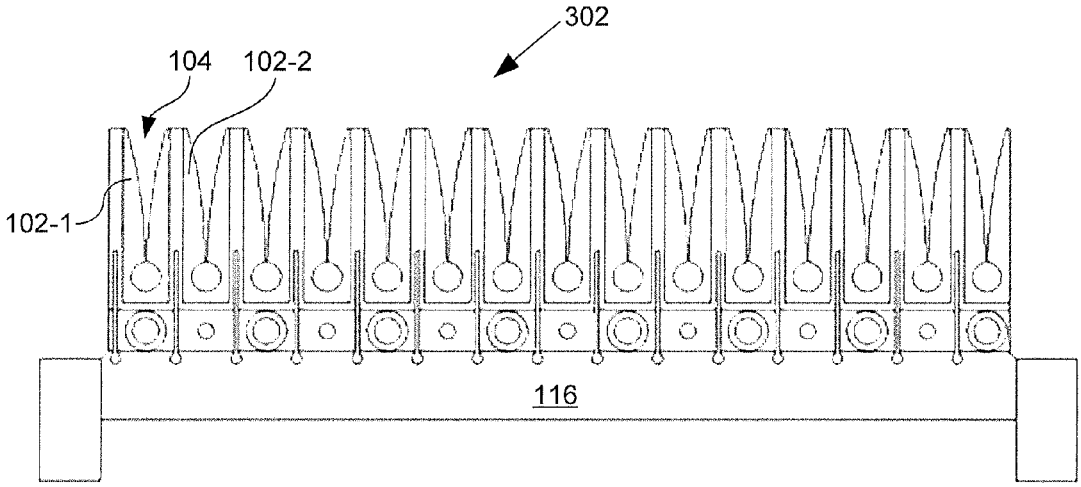
FIG. 3B is a front view of the row of the notch-antenna array elements shown in FIG. 3A.

FIG. 3A is an isometric view of a row of the notch-antenna elements shown in FIGS. 1A and 1B. FIG. 3B is a front view of the row of the notch-antenna elements shown in FIG. 3A. These antenna radiators are arranged as orthogonal antennas. In some embodiments, all orthogonal antenna radiators in the row (e.g., notch-antenna radiators 102-1 and 102-2 etc.) are formed integrally with one another.

Figures 4A, 4B, 4C:
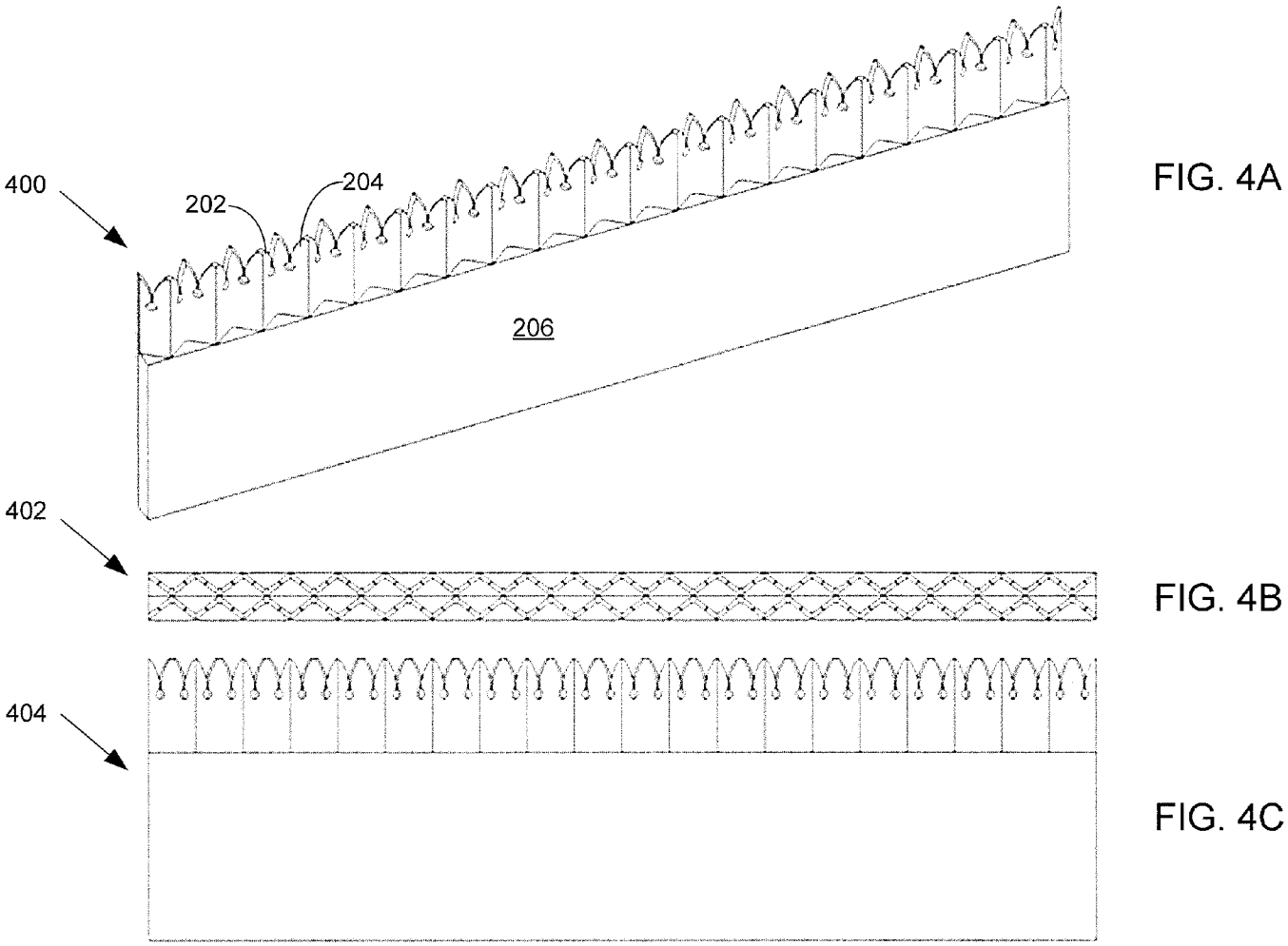
FIG. 4A is an isometric view of a row of notch-antenna array elements shown in FIGS. 2A and 2B.
FIG. 4B is a top view of two rows of the notch-antenna array elements shown in FIG. 4A.
FIG. 4C is a side view of the two rows of the notch-antenna array elements shown in FIG. 4B.

FIG. 4A is an isometric view of a row of notch-antenna array elements shown in FIGS. 2A and 2B. FIG. 4B is a top view of two rows of the notch-antenna array elements shown in FIG. 4A. FIG. 4C is a front view of the two rows of the notch-antenna array elements shown in FIG. 4B. These antennas are arranged as slant antennas. In some embodiments, all slant antennas in each row are formed integrally with one another. In some embodiments, adjacent rows of antenna radiators are flipped to face one another as shown in FIG. 4B.

Figure 5:
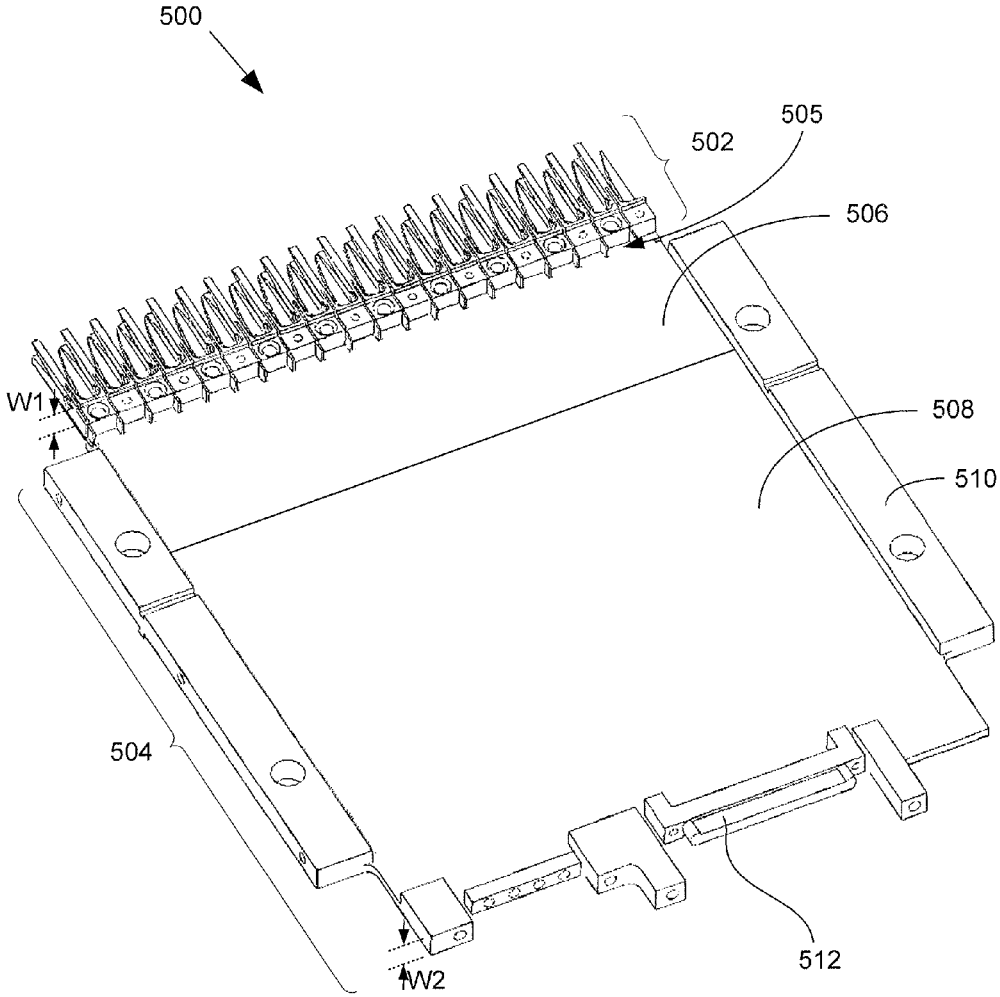
FIG. 5 is an isometric view of a slice of a notch-antenna array according to an embodiment of the invention.

FIG. 5 is an isometric view of a sub-array or slice 500 of a notch-antenna array according to an embodiment of the invention. The slice 500 includes a row of antenna radiators 502 and the walls and carrier for co-located integrated front end electronics 504. In some embodiments, the row of antenna radiators 502 are orthogonal antennas, as shown, but in other embodiments, the row of antenna radiators are a slant antennas or any other suitable notch-antenna.

In some embodiments, the front end electronics 504 include a limiter, LNA, Power amplifiers, vector modulators, attenuators, and/or dummy termination to terminate adjacent unused antenna elements in the array. In some embodiments, the front end electronics 504 also include time delay units (TDU) for frequency independent steering of array beams. In some embodiments, the front end electronics 504 include built-in test capability, analog beamforming components and digital circuitry controlling the array electronic scanning capability. In some embodiments, the front end electronics 504 include channels for liquid cooling of the active electronics.

In some embodiments, the electronics 504 include a module circuit card assembly (CCA) that includes an RF section 506 and a digital section 508. In some embodiments, a housing 510 surrounds the CCA and couples it to the row of antenna radiators 502.

In some embodiments, the RF section 506 includes limiters, phase shifters, attenuators, etc. In some embodiments, all of the electronics 504 have a footprint of the same size or smaller than the footprint of the row of antennas, i.e., the width of the electronics W2 is less than or equal to the width of the row of antennas W1.

In some embodiments, the end of the CCA opposite the row of antenna radiators 502 includes one or more electrical and mechanical connectors for connecting the slice 500 to a host device (not shown).

Figure 6:
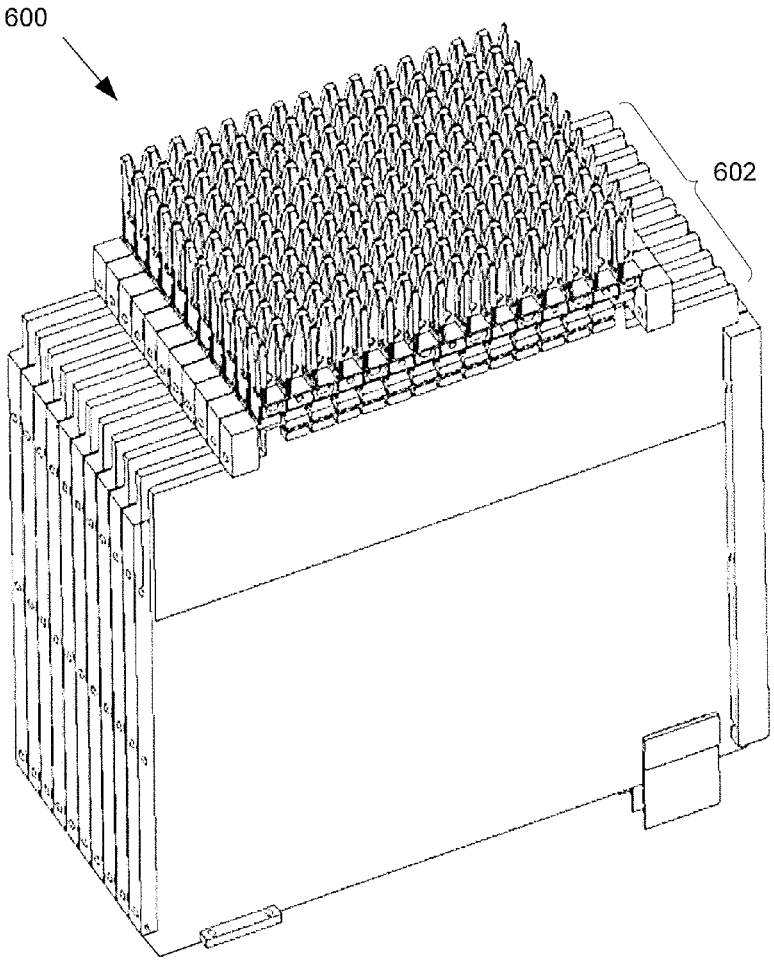
FIG. 6 is an isometric view of a stack of slices of a notch-antenna array according to an embodiment of the invention.

FIG. 6 is an isometric view of a stack 600 of slices 602 of a notch-antenna array according to an embodiment of the invention. The stack 600 includes multiple slices, such as the slices 500 of FIG. 5, are stacked adjacent to one another, as shown. By stacking N slices each having M elements in a row, an antenna array of N×M notch-antenna elements can be formed.

Figure 7:
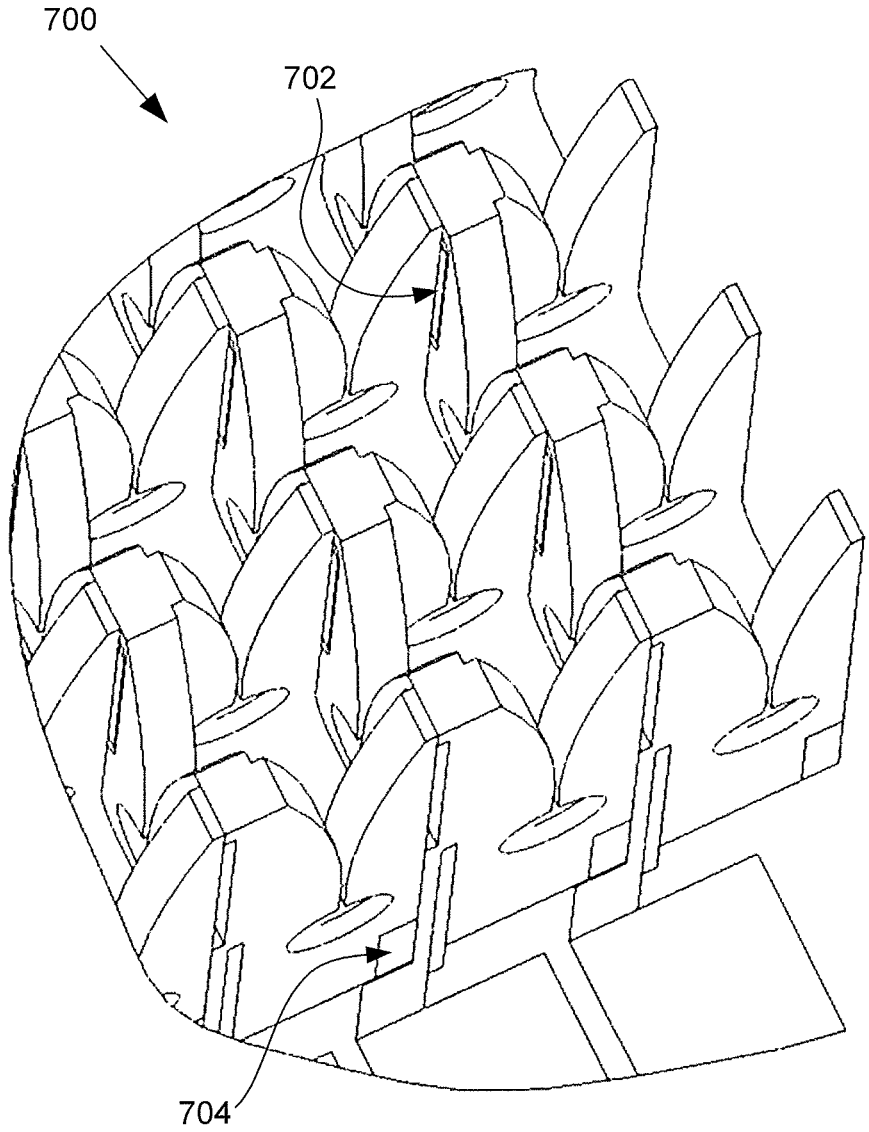
FIG. 7 is an isometric top view of a stack of slices of a notch-antenna array according to another embodiment of the invention.

FIG. 7 is an isometric top view of a stack 700 of slices of a notch-antenna array according to another embodiment of the invention. In some embodiments, each element includes one or more metallic/conductive spring fingers or conductive gaskets 702, 704. When the slices are stacked into an array, adjacent slices compress the metallic/conductive spring fingers or conductive gaskets 702, 704 electrically connecting all antenna radiators in the array. In some embodiments, each gasket is positioned in a respective depression or cutout formed in each element. In some embodiments, not every element includes one or more gaskets, e.g., every second element includes one or more gaskets.

Figure 8A:
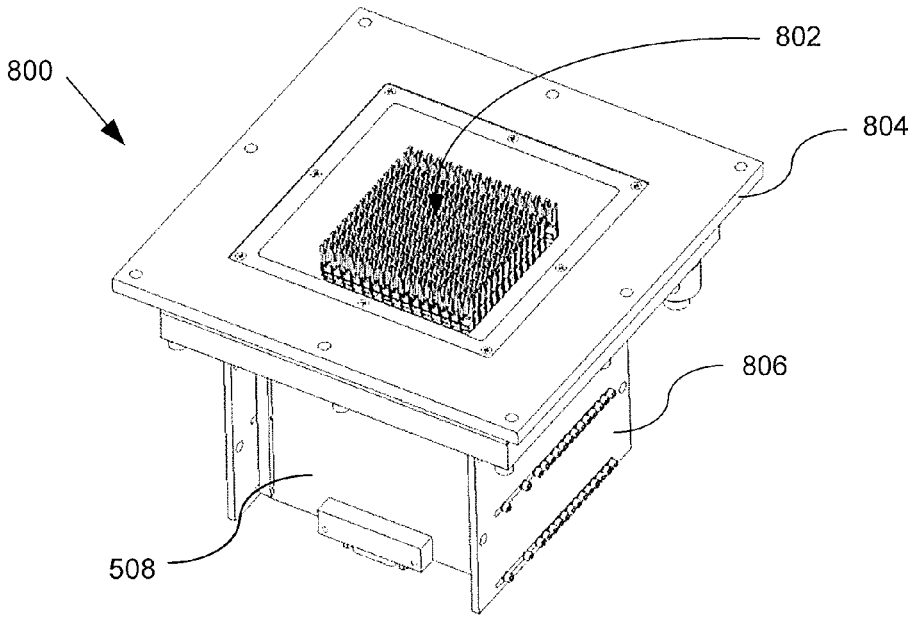
FIG. 8A is an isometric view of a partially assembled notch-antenna array according to another embodiment of the invention.
Figure 8B:
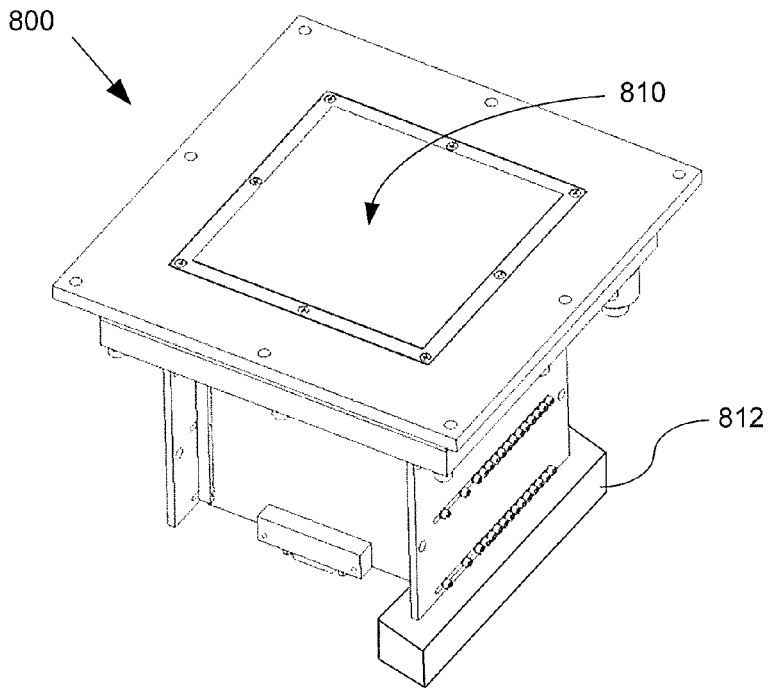
FIG. 8B is an isometric view of a more assembled notch-antenna array of FIG. 8.
Figure 9:
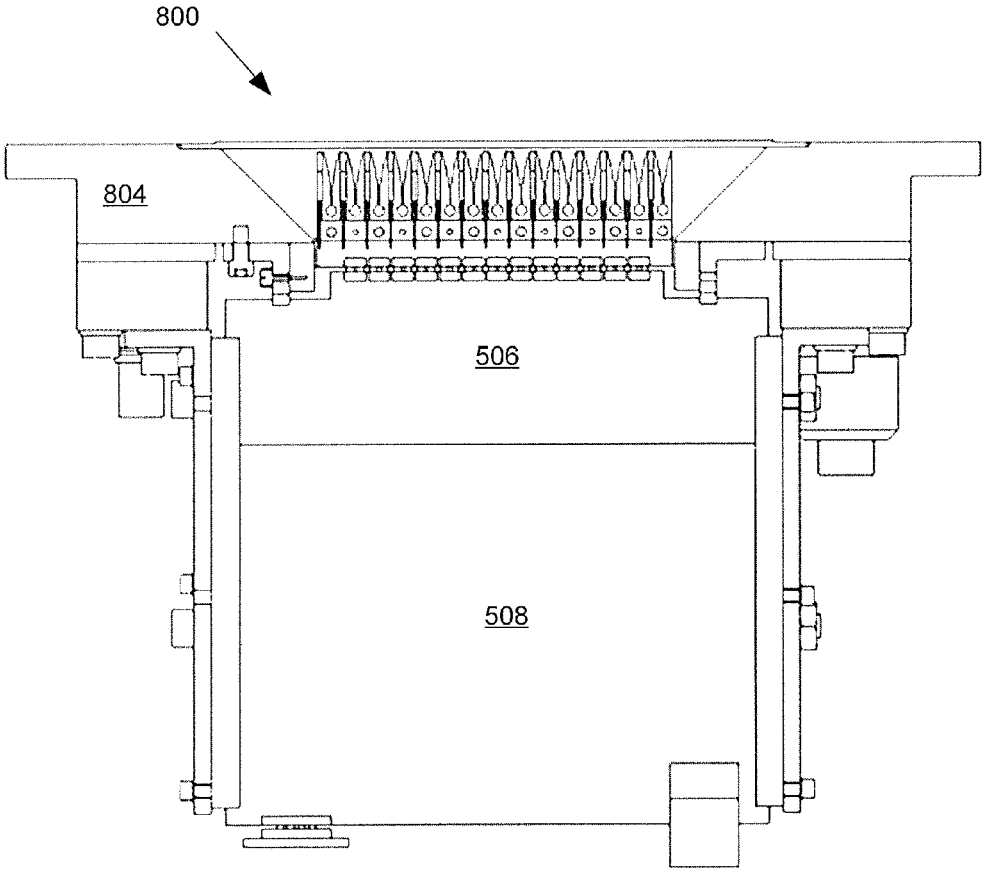
FIG. 9 is a side view of the partially assembled notch-antenna array of FIG. 8B.

FIG. 8A is an isometric view of a partially assembled notch-antenna array 800 according to another embodiment of the invention, while FIG. 8B is an isometric view of a mostly assembled notch-antenna array 800 of FIG. 8A. FIG. 9 is a side view of the mostly assembled notch-antenna array 800 of FIG. 8B. As shown, the notch-antenna array 800 includes the antenna array 802, a mounting ring 804, and host electronics 806. The digital section 508 of the CCA can be seen below the mounting ring 804. In the mostly assembled state shown in FIG. 8B, a radome 810 is mounted over the antenna array 802. The radome 810 is transparent to radio-frequency radiation. In other embodiments the radome may be tuned to specific RF band pass and RF band reject configurations. Although not shown, a bracket is mounted over the electronics 806. In some embodiments, one or more chill plates 812 are mounted to the bottom of the antenna array.

Figure 10:
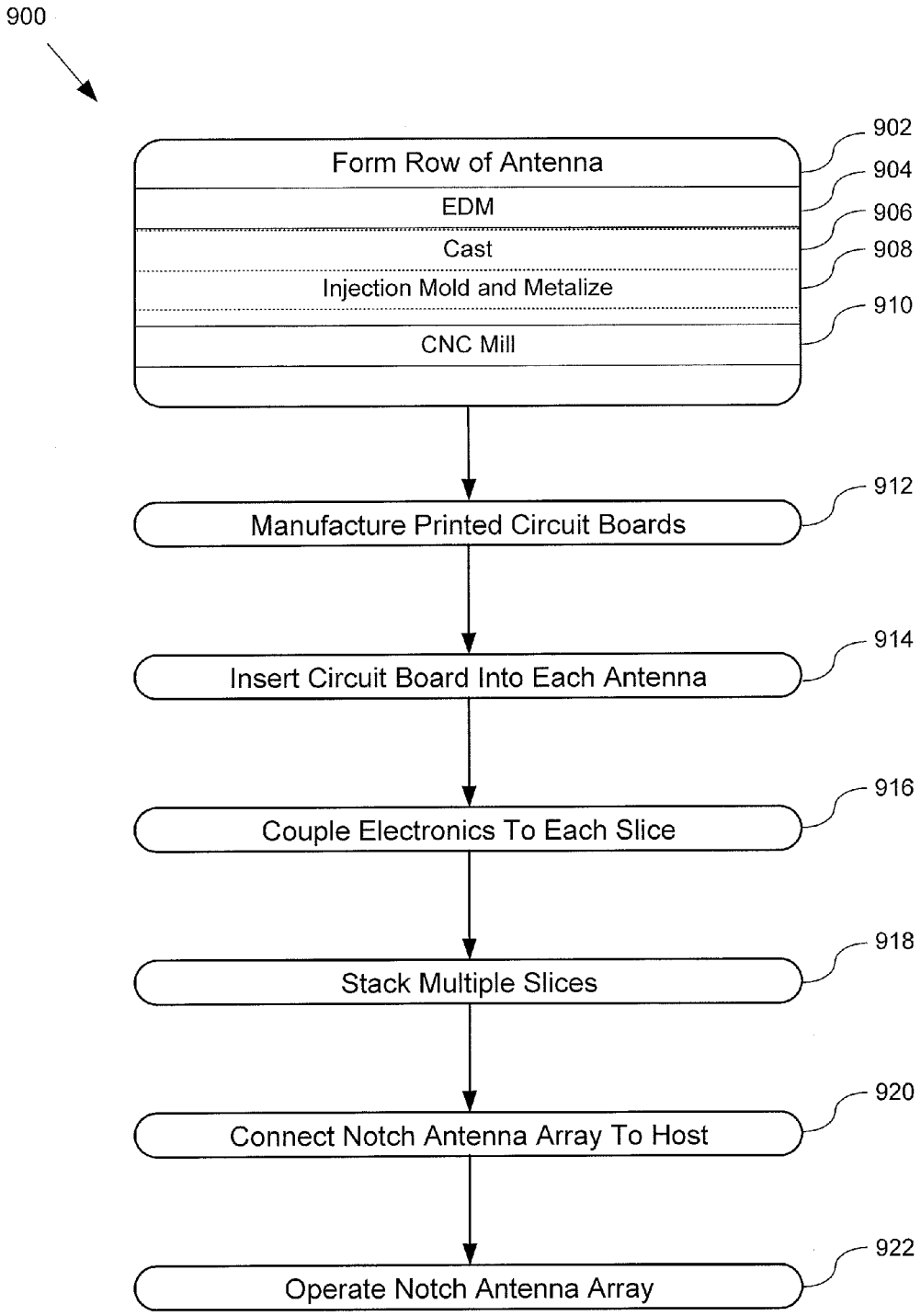
FIG. 10 is a flow chart of a method for making a notch-antenna array according to an embodiment of the invention.

FIG. 10 is a flow chart 900 of a method for making a notch-antenna array according to an embodiment of the invention. Initially, a single element, a row of elements (such as rows 300 or 400 of FIGS. 3A or 4A respectively), or an entire array of elements is formed at 902. To form a row, multiple elements, such as element 100 of FIG. 1, are first formed. Each element includes a pair of antenna radiators, and is integrally formed, as described above. In some embodiments, all elements in a row are integrally formed from the same material. For example, an entire row of elements is machined out of a block of aluminum. In other embodiments, the entire array of N×M elements is integrally formed. One advantage of this approach is that integral elements are electrically connected with each other and with the base plate/backplane metal structure.

In some embodiments, each element or a row of elements are formed by electric discharge machining at 904.

In some embodiments, multiple rows of elements are formed at the same time or during the same machining run. Simultaneous machining saves substantial manufacturing costs and insures precision positioning of the radiator elements. The manufacturing technique allows for greatly improved radiator to radiator element uniformity (e.g., wire EDM is capable of 0.0001 inch tolerance) thus improving radiation characteristics of the phased array.

In some embodiments, pre-machining key alignment, mounting, attachment, and cavities in each metal slice prior to stacking in the array configuration. Once assembled in the array configuration wire EDM is used to remove the metallic regions creating the notch radiators key dimensions albeit exponential tapper of linear taper etc. This process removes the material identically for each antenna radiator element in a column or row as desired. The resulting faceted array surface is now an effective array of identical or near identical radiators.

Figure 11A:
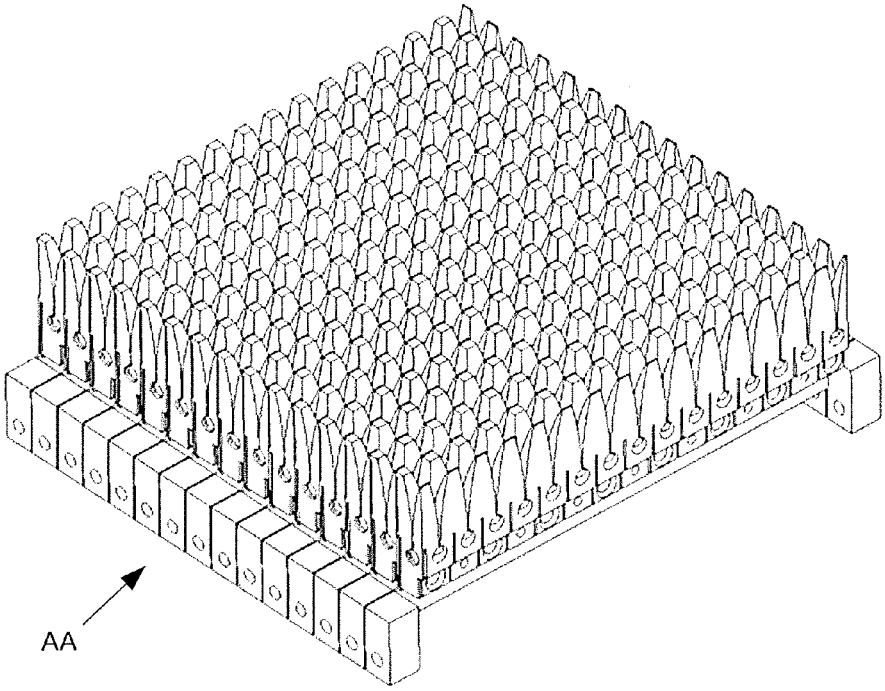
FIG. 11A is an isometric view of an array of elements that have undergone electrical discharge machining according to an embodiment of the invention.
Figure 11B:
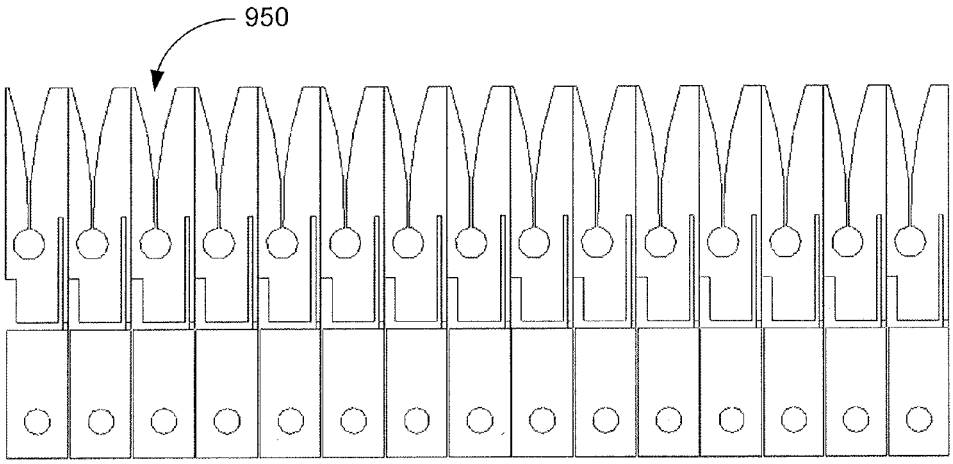
FIG. 11B is a front view of the array of elements of FIG. 11A.

FIG. 11A is an isometric view of an array of elements that have undergone electrical discharge machining (EDM) according to an embodiment of the invention. FIG. 11B is a front view of the array of elements of FIG. 11A.

Returning to FIG. 10, in an alternative embodiment, each element, a row of elements, or the entire array is formed by a casting process at 906. For example, a row of elements is formed by casting liquid aluminum into a mold. In yet another embodiment, each element, a row of elements, or the entire array is formed by injection molded plastic at 908. The injection molded plastic or composite is then metalized or plated with an electrically conductive coating to ensure all surfaces are intimately electrically connected, also at 908.

Figure 12A:
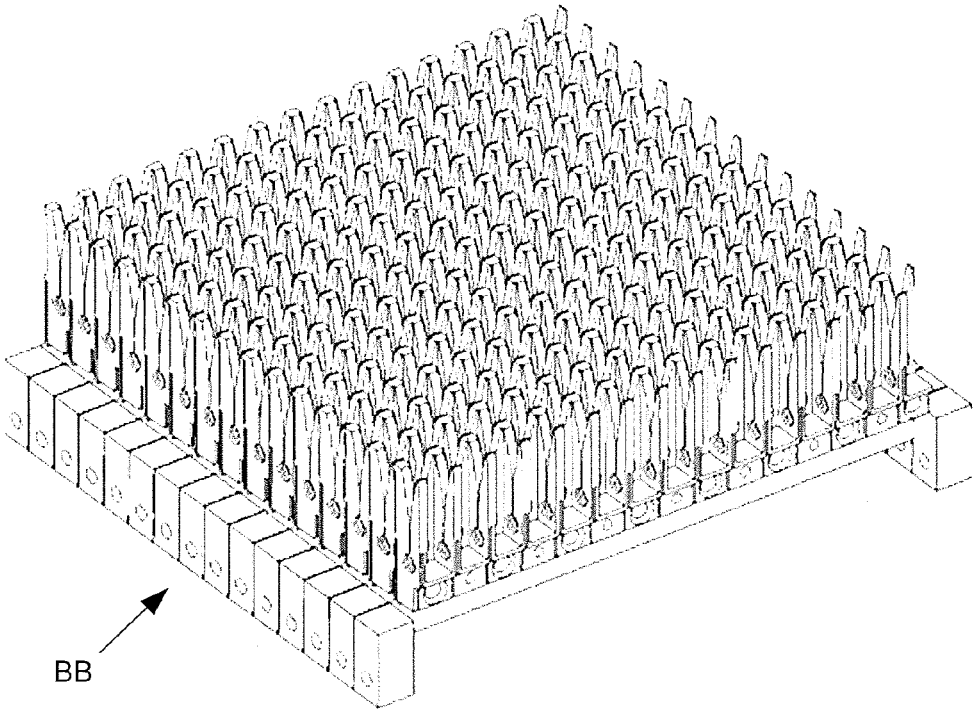
FIG. 12A is an isometric view of the array of elements from FIGS. 11A and 11B that have undergone further computer numerical control machining.
Figure 12B:
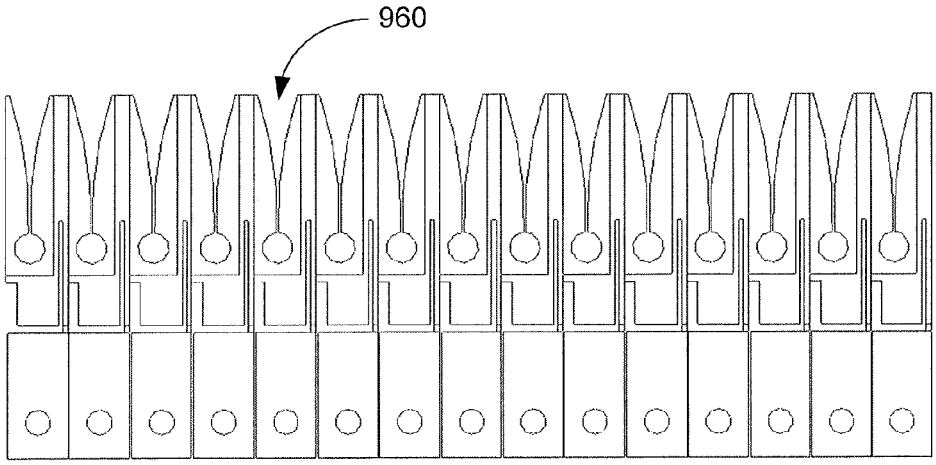
FIG. 12B is a front view of the array of elements of FIG. 12A.

In some embodiments, the EDM or casting may still need to be further post-machined to further refine the shape of the elements. In some embodiments, this fine machining is accomplished using a computer numerical control (CNC) milling machine at 910. FIG. 12A shows an isometric view of the array of elements from FIGS. 11A and 11B that have undergone further machining. FIG. 12B is a front view of the array of elements of FIG. 12A.

Although in this manufacturing technique results in identical elements for all rows and columns, the technique can also be used to yield different column elements from row elements resulting in different sized elements supporting different radiation characteristics in row elements from column elements. In alternative embodiments, the shape of each unique column or unique row of radiator elements can be varied to support amplitude and phase tapering at the individual antenna element level.

Typical broadband phased arrays have radiating element thickness on the order of ⅙th of the inter element spacing or smaller. For phased arrays operating at higher frequencies such as in the millimeter wave region element thickness may become impractically thin. Current notch arrays use 0.047" diameter semi-rigid cable embedded in elements with thickness ~1/16" or 0.141" semi rigid coax embedded in elements that are ~¼" thick. For mmwave arrays, an element with a thickness in the order of 0.025" would result in the use of 0.023" diameter Semi-Rigid coax. A resulting 0.002" wall thickness is impractical to support the manufacturing thus requiring thicker elements. Thicker elements would result in a larger percentage of the array aperture volume being filled with metallic structure which will have a detrimental effect on pattern shapes and operational bandwidth.

To overcome this problem the metallic elements may be machined thinner. By using the Pocket Feed Line approach as discussed previously a thin feedline assembly is inserted in the same manner. Although this approach is feasible, it may result extremely thin side walls and add unnecessary higher manufacturing cost. To overcome the thin side wall concern for manufacturing, the feed region is made thicker and more robust with the radiating portion of the notch element either stepped down in thickness or tapered in thickness. This tapering can be used to the antenna designer's advantage when designing the impedance matching network at the transition between the pocket feed line and the radiating notch-antenna. This element tapering or step down in thickness technique can be applied to the older coax embedded notch design as well to improve radiation characteristics and operational bandwidth.

Returning to FIG. 10, the circuit boards, such as PCBs 112, 144 of FIG. 1B, are manufactured at 912. Standard PCB manufacturing techniques are used to form the PCBs.

Next, each circuit board is inserted into its corresponding slot, such as slots 108,110 of FIG. 1B, at 914. In some embodiments, for the orthogonal antenna array, a single PCB (e.g., single printed circuit board 505, FIG. 5) may be used for all coplanar antenna radiators in a row, while separate PCBs are used for each of the antenna radiators perpendicular to the coplanar antenna radiators.

The remainder of the antenna electronics, such as electronics 504 of FIG. 5, are then coupled to the row of antenna at 916. The row of antenna radiators and the electronics together make up a slice, such as slice 500 of FIG. 5.

Multiple slices are then stacked together at 918, such as shown in FIG. 6. To ensure proper conductivity between the slices of the array, metallic/conductive spring fingers or conductive gaskets is used as shown in FIG. 7. To ensure proper compression of the electrically conductive spring fingers fasteners (not shown) may be used to connect each slice to the adjacent slice. The holes 120 (FIG. 1B) are used for attachment.

The entire notch-antenna array is then formed by connecting the stack of slices to a host at 920. The antenna array can then installed and operated at 922.

The foregoing description, for purpose of explanation, has been described with reference to specific embodiments. However, the illustrative discussions above are not intended to be exhaustive or to limit the invention to the precise forms disclosed. Many modifications and variations are also possible in view of the above teachings. The embodiments were chosen and described in order to best explain the principles of the invention and its practical applications, to thereby enable others skilled in the art to best utilize the invention and various embodiments with various modifications as are suited to the particular use contemplated. For example, while described in terms of a notch-antenna array, the invention may be applied to any type of antenna array. Furthermore, the above designs and manufacturing techniques can also be applied to single linear polarized arrays.

What is claimed is:

1. A notch-antenna comprising:

at least one notch-antenna array element comprising:

a first notch-antenna radiator defining a first slot;

a second notch-antenna radiator disposed at an angle to the first notch-antenna radiator, the second notch-antenna radiator defining a second slot, wherein the first notch-antenna radiator and the second notch-antenna radiator are formed integrally with one another;

a first printed circuit board configured to be received in the first slot, the first printed circuit board comprising a first printed circuit board antenna feedline that exits the first printed circuit board at a first printed circuit board electrical output at a first edge of the first printed circuit board; and a second printed circuit board configured to be received in the second slot, the second printed circuit board comprising:

a first antenna feedline of the second printed circuit board that exits the second printed circuit board at a first electrical output of the second printed circuit board at a first edge of the second printed circuit board, and a second antenna feedline of the second printed circuit board electrically coupling an electrical input of the second printed circuit board at a second edge of the of the second printed circuit board to a second electrical output of the of the of second printed circuit board at the first edge of the of the second printed circuit board, wherein the first electrical output of the first printed circuit board is configured to both align with and electrically couple to the electrical input of the second printed circuit board when the first and second printed circuit boards are received within their respective first and second slots.

2. The notch-antenna of claim 1, wherein each of the first and second notch-antenna radiators comprises substantially planar opposing surfaces and a flared notch formed therein.

3. The notch-antenna of claim 2, wherein the first slot is defined between substantially planar opposing surfaces of the first notch-antenna radiator and wherein the second slot is defined between substantially planar opposing surfaces of the second notch-antenna radiator.

4. The notch-antenna of claim 1, wherein the at least one notch-antenna element is a solid block of material with the first and second slots defined therein.

5. The notch-antenna of claim 1, wherein the first electrical output of the first printed circuit board directly contacts the electrical input of the second printed circuit board when the first and second printed circuit boards are received within their respective first and second slots.

6. The notch-antenna of claim 1, wherein each of the printed circuit boards comprises a portion that mates with a complementary portion formed on their respective first and second slots when each printed circuit board is received within its respective first or second slot.

7. The notch-antenna of claim 1, wherein each of the printed circuit boards comprises opposing substantially planar dielectric layers with a conductive layer forming their respective antenna feedlines there between.

8. The notch-antenna of claim 7, wherein each of the printed circuit boards further comprises:

a first dielectric layer on a first side of the first conductive layer;

a second dielectric layer on a second side of the first conductive layer;

a second conductive layer on the first dielectric layer; and a third conductive layer on the second dielectric layer.

9. The notch-antenna of claim 1, wherein the first and second notch-antenna radiators each comprise a feed hole disposed through their respective substantially planar opposing surfaces, each feed hole is disposed about an axis.

10. The notch-antenna of claim 9, wherein the first and second printed circuit boards each comprise a through hole where each respective through hole is aligned with the axis when each printed circuit board is received within its respective first or second slot.

11. The notch-antenna of claim 1, wherein the element is metalized injection molded plastic.

12. The notch-antenna of claim 1, wherein the angle is 90 degrees and the element is a slant antenna.

13. The notch-antenna of claim 1, wherein the angle is 90 degrees and the element is an orthogonal antenna.

14. The notch-antenna of claim 1, wherein the at least one notch-antenna element is one of multiple identical notch-antenna elements arranged in a row, wherein all the multiple identical notch-antenna elements in the row are formed integrally with one another.

15. The notch-antenna of claim 14, further comprising multiple identical parallel rows of multiple identical notch-antenna elements.

16. The notch-antenna of claim 14, further comprising electronics electrically coupled to each row of the multiple identical notch-antenna elements, wherein the electronics for each row have a footprint no larger than the row of multiple identical notch-antenna elements.

17. The notch-antenna array of claim 14, wherein each second notch-antenna radiator of each notch-antenna element in a given row of multiple identical notch-antenna elements includes its respective second slot, and all respective second slots are coplanar and configured to receive a single second printed circuit board therein.

18. The notch-antenna of claim 17, wherein each first notch-antenna radiator of each notch-antenna element in the given row of multiple identical notch-antenna elements includes its respective first slot, and each respective first slot is configured to receive its own first printed circuit board therein.

19. The notch-antenna of claim 17, wherein feedlines of each printed circuit board are transitioned to a common printed circuit board.

* * * * *

UNITED STATES PATENT AND TRADEMARK OFFICE

CERTIFICATE OF CORRECTION

PATENT NO. : 9,270,027 B2
APPLICATION NO. : 13/758789
DATED : February 23, 2016
INVENTOR(S) : Waschenko et al.

It is certified that error appears in the above-identified patent and that said Letters Patent is hereby corrected as shown below:

In the claims,

Claim 1, column 10, line 19, delete “notch-antenna array element” and insert --notch-antenna element--;

Claim 1, column 10, line 44, delete “of the second printed” and insert --second printed--;

Claim 1, column 10, line 45, delete “output of the of the of second” and insert --output of the second--;

Claim 1, column 10, line 46, delete “edge of the of the second” and insert --edge of the second--.

Signed and Sealed this
Third Day of May, 2016

Michelle K. Lee

Michelle K. Lee
*Director of the United States Patent and Trademark Office*